United States Patent [19]

Hewitt

[11] 4,130,085

[45] Dec. 19, 1978

[54] APPARATUS FOR MANUFACTURING SPOT TEST INDICATORS

[75] Inventor: Raymond Hewitt, Stanhope, N.J.

[73] Assignee: Becton, Dickinson and Company, Rutherford, N.J.

[21] Appl. No.: 795,956

[22] Filed: May 11, 1977

[51] Int. Cl.[2] ..... B05C 5/02

[52] U.S. Cl. ..... 118/315; 33/32 E; 33/41 D; 118/401

[58] Field of Search ..... 23/259; 33/32 E, 34, 33/41 D; 118/221, 222, 315, 612, 401; 427/286

[56] References Cited

U.S. PATENT DOCUMENTS

| | | | |
|---|---|---|---|
| 1,191,725 | 7/1916 | Paulsen | 33/41 D |
| 2,084,651 | 6/1937 | Mecklenburg et al. | 23/259 UX |
| 2,578,918 | 12/1951 | Boddy et al. | 118/612 X |
| 2,688,189 | 9/1954 | Klauss | 33/32 E X |
| 2,754,228 | 7/1956 | Bede | 118/600 X |
| 2,800,418 | 7/1957 | Cannon | 118/221 X |
| 2,916,012 | 12/1959 | Hergenrother | 118/315 |

FOREIGN PATENT DOCUMENTS

| | | | |
|---|---|---|---|
| 157584 | 12/1939 | Fed. Rep. of Germany | 118/315 |

*Primary Examiner*—Robert Mackey
*Attorney, Agent, or Firm*—Kane, Dalsimer, Kane, Sullivan and Kurucz

[57] ABSTRACT

Apparatus is disclosed which is useful for applying lines of an aqueous liquid reagent to a moving hydrophobic sheet. The apparatus makes application of the lines in such a manner that a constant volume of reagent is applied to a constant surface area of the moving sheet, providing a uniform reagent site on the hydrophobic surface. The apparatus is particularly useful to manufacture spot test indicators of the type for detection of chemical substances dissolved in aqueous media.

7 Claims, 3 Drawing Figures

APPARATUS FOR MANUFACTURING SPOT TEST INDICATORS

BACKGROUND OF THE INVENTION

1. Field of the Invention

The invention relates to appartus for coating a moving sheet or web with a liquid and more particularly relates to apparatus for creating a predetermined pattern of lines on a moving sheet with a precise volume of liquid.

2. Brief Description of the Prior Art

Recently issued U.S. Pat. No. 3,964,871 describes chemical spot test indicators of the type which comprise a hydrophobic support having disposed thereon a plurality of reagents for the detection and quantification of chemical substances dissolved in biological liquids. The reagents are generally deposited from aqueous solutions.

In most quantitative titrations, it is necessary for accuracy that precise and known quantities of test reagent be exposed for reaction to a fixed volume of solution to be tested. Thus, in chemical spot test indicators of the type described in U.S. Pat. No. 3,964,871 it would be ideal to have a known and specific quantity of reagent deposited on a support member in such a manner that upon immersion in the solution being tested, the reagent remains in place and the site is exposed to a fixed and predetermined volume of solution being tested.

It has been discovered that the highest degrees of accuracy of such test indicators is dependent in part upon the conditions of manufacture. More specifically, the most accurate indicators of the type disclosed in U.S. Pat. No. 3,964,871 are those prepared by applying a constant volume of reagent (in liquid form) to a constant area of the hydrophobic support member. Theoretically the dried reagent sites will be uniform in respect to configuration, dimensions, weight of reagent and location in respect to surrounding hydrophobic surface. If the reagent sites are uniform in regard to the above parameters, they may be expected to imbibe uniform volumes of test specimens. The latter is essential for accurate quantitative analysis by comparative methods of those skilled in the art appreciate.

The art is replete with descriptions of apparatus designed to make uniform coatings on moving webs. For example, U.S. Pat. No. 3,964,871 describes apparatus which serves to apply a coating of uniform thickness to a moving web by applying the coating in excess and then removing the excess. In U.S. Pat. No. 2,887,087 and 3,292,573 disclosure is made of apparatus for applying uniform weights of coating materials over given surface areas of a moving web by altering the concentration of the coating material to compensate for changes in the speed of the moving web. The U.S. Pat. No. 3,186,378 describes apparatus for the accurate deposit of a liquid in a straight line on a moving web, parallel to the web edge. U.S. Pat. No. 3,402,695 discloses apparatus for coating the whole surface of a moving web having varied width, by controlled pumping or supply of the coating to the applicator head. The control is derived from sensing the speed of the moving web.

Although the prior art apparatus has evolved to meet one or more needs also found in the manufacture of chemical test indicators of the type described in the U.S. Pat. No. 3,964,871, no single machine or apparatus has been available to meet all of those needs, i.e.; the need to deposit a constant volume of an aqueous liquid on a constant area of a hydrophobic sheet so as to obtain lines of reagent sites which will imbibe uniformly the same volumes of test specimen at any site where contact with the specimen for analysis is made. The apparatus of the present invention accomplishes this desired result. The apparatus of the invention provides a means to manufacture chemical spot test indicators of the type which comprise a support member and a plurality of reagents adhered thereto, which is useful for the detection and quantitation of a chemical substance dissolved in aqueous media. The apparatus obviates a number of the above-described shortcomings of the prior art devices in that it provides for a precise proportion of test reagent to be applied to a plurality of given sites on the support. The test indicators prepared with the apparatus of the invention will imbibe at each of the reagent sites, a predetermined volume of test solution (the volume which will be predetermined volume of test solution (the volume which will be imbibed is proportional to the volume of aqueous test reagent deposited on the support). Thus, it is possible to control the ratio of reagent to specimen by the accurate control of the volume of reagent liquid deposit applied to the support, relative to the size and configuration of the site receiving the liquid deposit. The test indicators prepared with the apparatus of the invention provide more rapid readout times and improved accuracy. The apparatus of the invention is particularly advantageous for the manufacture of spot test indicators being a plurality of reagent sites for comparative readout.

SUMMARY OF THE INVENTION

The invention comprises apparatus for applying a predetermined pattern of an aqueous liquid reagent to a flat, moving sheet having a hydrophobic surface, which comprises;

- a fixed platen having a flat surface to support a sheet traveling thereover;
- means for feeding a flat sheet to the surface of said platen;
- means for drawing the sheet across the surface of said platen at an adjustable, fixed speed;
- a header for mounting a plurality of liquid dispensing nozzles over the surface of said platen;
- means for positioning the nozzles a uniform distance from the surface of the platen; and
- means for supplying to said nozzles an uninterrupted flow of liquid reagent, at a constant volume rate.

DETAILED DESCRIPTION OF THE PREFERRED EMBODIMENT OF THE INVENTION

The apparatus of the invention is useful to coat predetermined line patterns of aqueous liquids on hydrophobic sheets or support webs. Representative of such hydrophobic sheets are sheets of synthetic polymeric materials such as polyethylene, polypropylene and the like which are naturally hydrophobic. Hydrophillic materials like paper, coated with hydrophobic materials such as silicone compositions to render their surfaces hydrophobic may also be processed with the apparatus of the invention.

Although the apparatus of the invention may be used to apply any aqueous reagent composition, e.g.; any reagent composition containing water as a solvent or vehicle, it is particularly advantageous when the reagent composition includes a substance which is bibulous in character. For example, methylcellulose may be a component of the reagent composition or the reagent material itself may be a protein (enzyme), buffer salt, etc. which itself is bibulous in character. Generally, the reagent compositions used in the apparatus of the invention include a surface-active or "wetting" agent to facilitate adherence of the reagent to the applied site on the hydrophobic sheet or web. Illustrative of wetting agents or surface-active agents which may be included in the reagent compositions are non-ionic surface active agents such as polyoxyethylene sorbitan monolaurate, polyoxyethylenepolyoxypropylene-polyoxyethylene glycol, polyoxyethylene glycols having a molecular weight of at least 500 and the like; anionic surface-active agents such as the dioctyl ester of sodium sulfosuccinate, sodium lauryl sulfate and the like; and cationic surface-active agents such as N-methyltrimethylenediamine, cetyl pyridinium chloride and the like. It is desirable that the surface-active agent to be applied in uniform concentrations and such is accomplished in the preferred apparatus of the invention.

It will be appreciated that one of the principal objects of the invention is to apply a quantity of chemical test reagent over a predetermined surface area of hydrophobic carrier material. More specifically, the carrier or sheet material is to be coated with reagents of different concentrations or types with the different concentrations or types separated by hydrophobic zones of the sheet material. A unique feature of the apparatus of the invention is the accurate control of the volume of reagent liquid relative to the size and configuration of the coated hydrophobic area, so that when the finished indicator devices are titrated, a consistent volume of specimen will adhere to the reagent sites. Thus, it will be possible to control the ratio of reagent to specimen, thereby displaying the concentration of a substance in, for example, biological fluids at predetermined levels.

Figure 1:
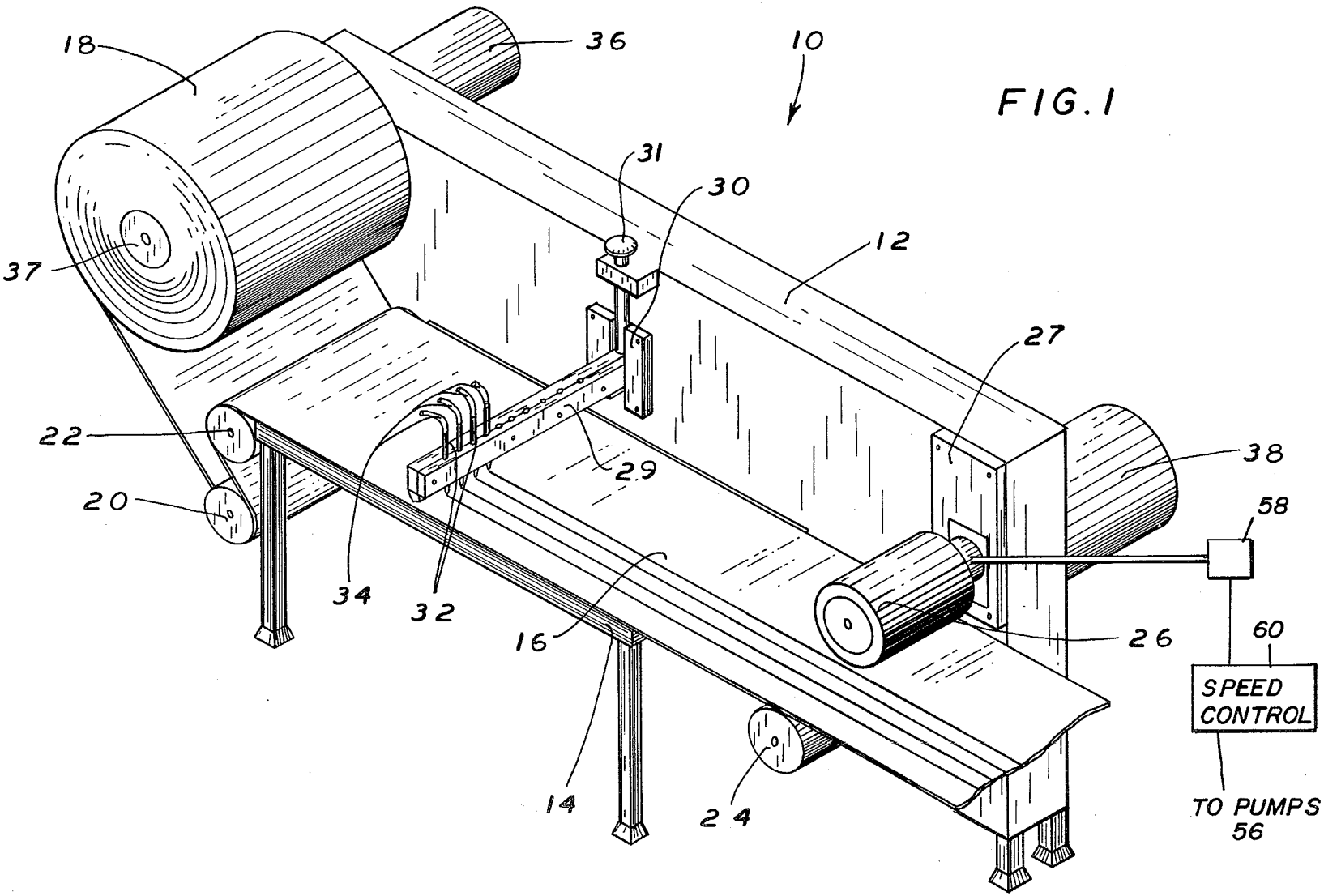
FIG. 1 is an isometric view of a portion of a preferred embodiment apparatus of the invention.

Referring to FIG. 1, an isometric view of a preferred apparatus 10, it will be seen that the apparatus 10 comprises a supporting frame 12 upon which there is rigidly mounted in fixed position a platen surface 14. Platen 14 has an upper surface which is flat and smooth. As shown in FIG. 1, a sheet 16 is passing over and is supported by the flat upper surface of platen 14. Sheet 16 is fed to the flat surface of platen 14 from a roll 18 which is unwound and tensioned by passage over rollers 20 and 22 which are mounted on frame 12. Likewise, it is seen that the roll 18 is mounted on frame 12. The sheet 16, which has a hydrophobic surface, is drawn across the flat upper surface of platen 14 by drive roller 24 which engages the sheet 16 in a nip formed with pinch roller 26. Slippage between sheet 16 in the nip between drive roller 24 and pinch roller 26 is prevented and lateral alignment of sheet 16 is held by a rubber facing on pinch roller 26 which presses the sheet 16 against drive roller 24. The rubber covered pinch roller 26 is supported in a carriage 27 with adjustable vertical positions. The softness of the rubber face on pinch roller 26 is important and preferably the rubber surface will have a durometer of from about 40 to about 50 (Shore A). Of course, any elastomeric facing material may be employed and it is not critical to the apparatus that the elastomer be rubber. From empirical experience, it has been determined that the drive roller 24 should be driven so as to pull sheet 16 at a speed of from about 5 to about 20 feet per minute. Variations in speed may be accomplished by using a DC motor 38 with control provisions for varying the speed of the motor 38 (controls not shown in FIG. 1). Motor 38 and drive roller 2 are also mounted on the frame 12. To insure a direct pull of sheet 16, without rippling of the sheet 16, it is necessary to control the speed of movement of sheet 16 to within 1% of the determined set speed. In the preferred embodiment apparatus 10, this speed regulation is assisted by applying hold back tension to feed reel 18. This may be accomplished by a brake mechanism 36 connected to the feed roller 37. The degree of braking applied by brake 36 to feed roller 37 may be varied and optimized by trial and error. When proper braking tension is applied to feed roller 18, the paper will not flutter during its passage over the smooth face of platen 14. It will be seen that the combination of brake 36, feed roller 18, tension rollers 20, 22, pinch roller 26 and driving roller 24 together comprise a driving and control means for moving sheet 16 at a desired rate and under desired circumstances. Pinch roller 26 does not extend outwardly from frame 12 a distance equal to the position of nozzles 32 so that it will not touch the surface of sheet 16 in the zone receiving a liquid application. This assures that the applied surface will not be smeared by contact with pinch roller 26. The length of the platen 14 should be sufficient to enable sheet 16 to flatten out before passing under nozzles 32. A proper length can be determined by those skilled in the art, based upon the nature of sheet 16. Mounted on frame 12 and positioned over the upper flat surface of platen 14 is a split header 29 mounted in carriage 30 for movement and adjustment in a vertical plane. Split header 29 is adapted to receive and hold in a rigid position any number of fluid dispensing nozzles 32. In FIG. 1, four fluid dispensing nozzles 32 are shown mounted in split header 29 and attached to supply conduits 34. The nozzles 32 are positioned to dispense a liquid reagent composition in a predetermined pattern to the hydrophobic sheet 16 during its passage under split header 29.

Figure 2:
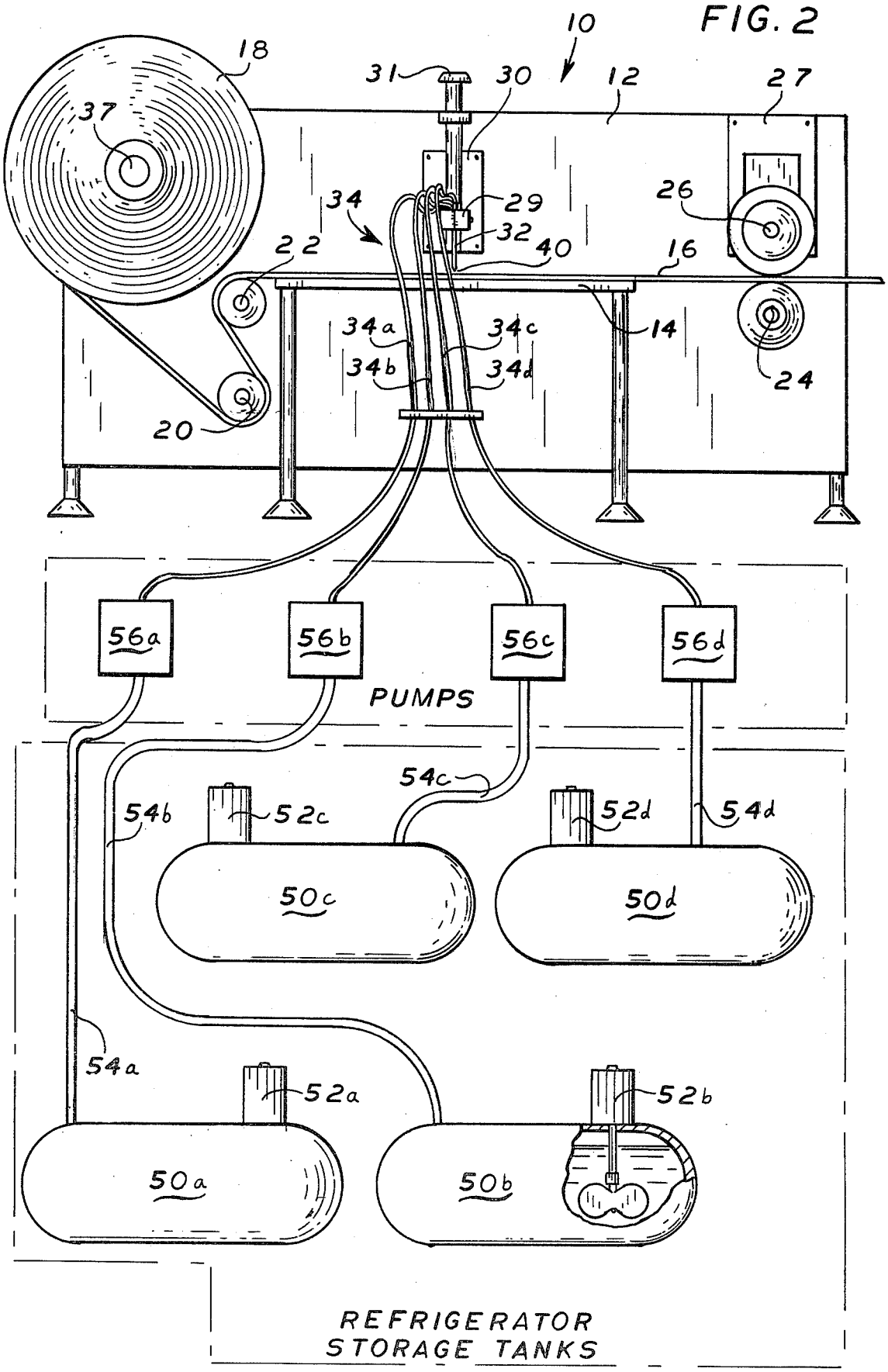
FIG. 2 is a side view of the embodiment apparatus seen in FIG. 1, and a schematic diagram of the remaining portion of the apparatus.

Referring now to FIG. 2, a side elevation of the apparatus 10 as shown in FIG. 1, but with the addition of a schematic diagram to show the connection of supply conduits 34 distal to its connection to a nozzle 32, one may obtain a greater appreciation of the complete apparatus 10. In order to obtain the highest possible order of accuracy in test indicators prepared with the apparatus of the invention, solids in the reagent liquid should be kept in suspension with a uniform space density at the time of application to the moving sheet 16. Desirably there are no flow path obstructions in the system bringing the liquid reagent to nozzles 32, where solids in suspension might accumulate. Further, in typical reagents there are often biological materials which are sensitive to oxidation, contamination, heat and other destructive environmental conditions. Desirably, therefore, an important objective is to consider the sensitive nature of reagent compounds and avoid any possibility of their degradation prior to, during or immediately after application to moving sheet 16. To meet these requirements, the apparatus 10 preferably includes refrigerator means for each reagent composition to be applied to the hydrophobic sheet 16. Each reagent liquid composition is desirably contained in an inert reservoir receptacle which is stored under refrigeration and preferably constantly stirred with a commercial propeller mixer or equivalent device. As shown in FIG. 2, refrigerator storage vessels 50*a*, 50*b*, 50*c* and 50*d* with stirring means 52*a*, 52*b*, 52*c* and 52*d*, respectively, fulfills this need. Individual refrigerator and mixing storage is desirably provided for each of the reagents to be applied to sheet 16. Each refrigerator storage vessel 50*a*, 50*b*, 50*c* and 50*d* is enclosed to protect the stored reagent from light or air contamination. Desirable, the vessels 50*a–d* are placed at a lower elevation than the applicating nozzles 32 to prevent back siphoning. The liquid reagent from each storage vessel 50*a–d* is drawn through a conduit 54 to a pump 56 (to a respective pump 56*a*, 56*b*, 56*c* or 56*d*). The pumps 56*a–d* receive from respective conduits 54*a–d* for each of supply conduits 34*a*, 34*b*, 34*c* and 34*d*, respectively. Each pump 56*a–d* for each of conduits 34*a–d* may be a selectively operable metering pump. The volume flow for each reagent provided by conduits 34 is preferably controlled by syringe pumps, particularly the Sage 220 Syringe Pump (Orion Research Incorporated, 380 Putman Avenue, Cambridge, Mass.). However, any equivalent pump may be preferably employed. The Sage 220 pump withdraws an unlimited volume of fluid from a reservoir and delivers the fluid continuously at a highly reproducible, pulse free rate. As shown in FIG. 2, applicator nozzles 32 are positioned a distance 40 above the surface of sheet 16 during its passage underneath nozzles 32. Desirably, the nozzles 32 receive a flow from the pumps 56*a–d* at a rate of from about 2 to about 4 microliters per linear inch.

Figure 3:
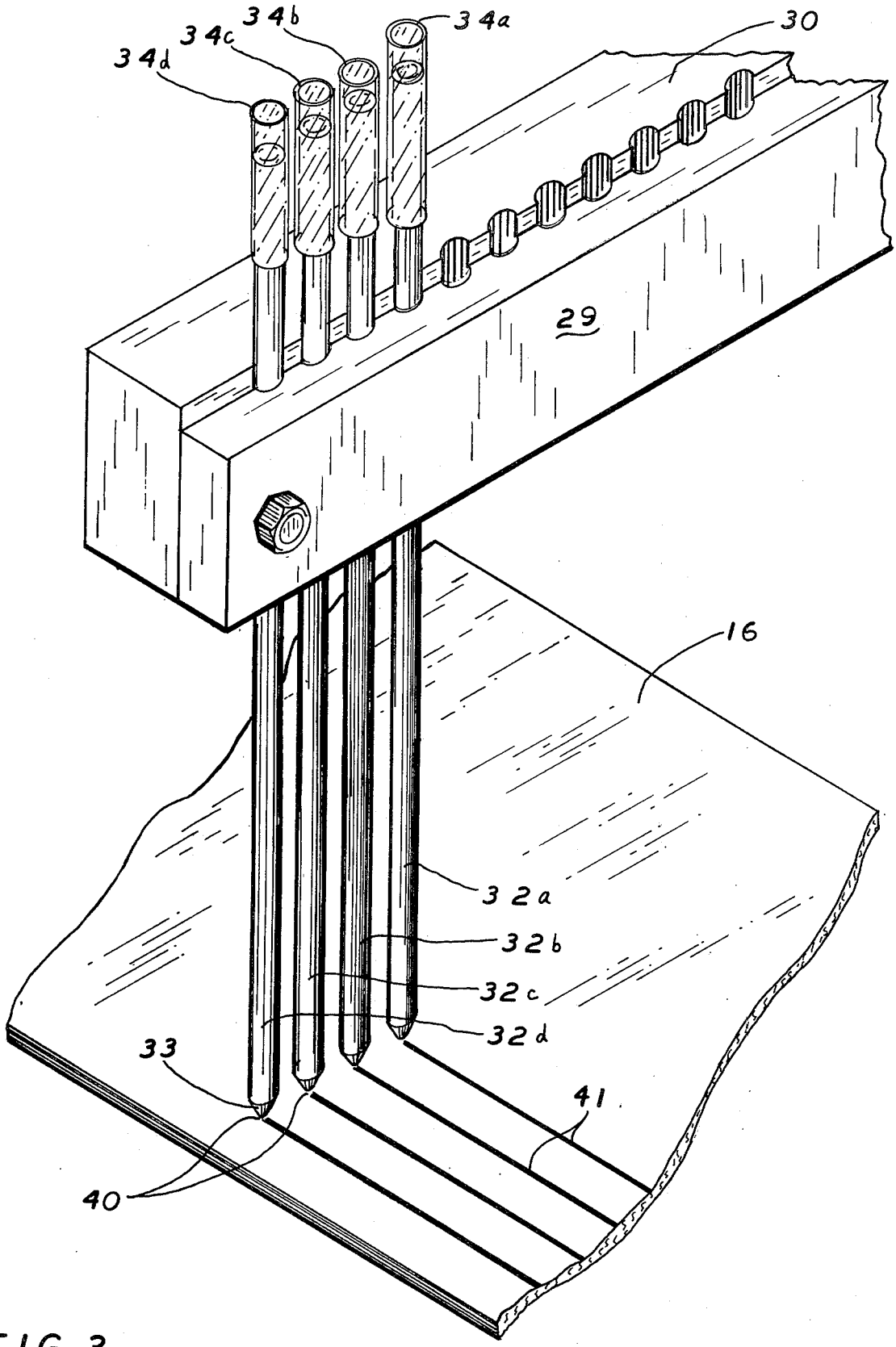
FIG. 3 is an enlarged view of the nozzle component of the apparatus of FIG. 1.

FIG. 3 is an enlarged view of the nozzles 32 and shows in greater detail their mounting above sheet 16 in split header 29. It will be appreciated that any number of reagent concentrations or types may be applied with the apparatus of the invention, within limits of convenient sheet width, minimum reagent line width and like considerations. As shown in FIG. 3, four liquid reagent materials are being supplied by individual supply conduits 34A, 34B, 34C and 34D to nozzles 32A, 32B, 32C and 32D, respectively. It will be appreciated that it is important that each site to receive liquid reagent on sheet 16 have a uniform dimension, i.e.; each site should have the same surface area. In addition, each site should be separated from the others by hydrophobic surface area and each reagent site should be substantially surrounded by hydrophobic surfaces. This encourages test specimen brought in contact with the indicator to be repelled into the reagent sites. Likewise, the quantity of the reagent deposited, which in turn is controlled by the width and thickness of the site, influences the rate of the reaction and the size of the specimen picked up. The wider the band, the larger the pick up and the thinner the band the more rapid will be the rate of reaction during use of the indicator device. Mechanically, the width of the reagent siter deposited on sheet 16 is governed by the size of the apertures in nozzles 32A-D and the overall pressure of the pumps 56 and the speed at which the sheet 16 passes under the nozzles 32. With proper control of these factors, the width of applied lines to the surface of sheet 16 is uniform, with sharp and legible distinctions between lines. Each line is separated by a hydrophobic barrier by spacing the nozzles 32A, 32B, 32C and 32D apart the desired distance as shown in FIG. 3. As also shown in FIG. 3, the nozzles 32A-D are constructed of inert, rigid tubing with the output tip 33 machined smooth and square to the axis of the tube. The predetermined width of the line to be applied to sheet 16 is largely effected by the inside diameter of the nozzle. Any desired diameter may be selected. Predetermining factors are readability of the lines and costs of reagent to be applied. Small width changes in the lines to be applied are effected by the distance of the nozzle orifice above sheet 16. This distance may be determined by adjusting the gap between the nozzles 32 and thr rigid flat platen 14 which supports sheet 16 during its passage beneath the nozzles 32. The nozzles should be set as close to the sheet 16 as physically possible. Again, the inventor's experience has been that the gap between nozzles 32 and platen 14 are optimally set a distance of about 0.001 inches above the sheet 16. The split header 29 locks the position of the nozzles 32 at the desired height. Minor adjustments may be made using the carriage 30 adjusting screw 31 (see FIG. 1). As also shown in FIG. 3, four longitudinally extending lines 41, transversely spaced apart at predetermined intervals, are applied to the surface of sheet 16 in a continuous length and with uniform width.

In operation, each reservoir 50 is filled with the appropriate reagent liquid concentrate. The pumps 56 are primed to eliminate any air pockets. A roll of sheet material 16 is installed on apparatus 10, brake tension is set according to experience and the gap between nozzles 32 and platen 14 is set with a feeler gauge. The rubber covered pinch roller 26 is adjusted downward onto sheet 16 to prevent slippage with the pull or driving roller 24. Pumps 56 and drive roller 24 are energized to apply the liquid reagent to the sheet 16. The coated sheets 16, passing beyond drive roller 24 may be cut into any desired length. The coated sheets may also be passed through a dryer to dry the applied lines or such may be allowed to occur at ambient (room) temperatures. The sheet 16 may then be cut into any desired width to obtain indicator devices such as those described in U.S. Pat. No. 3,964,871.

Those skilled in the art will appreciate that many modifications may be made to the above described preferred embodiment without departing from the spirit and scope of the invention. For example, sensing means such as tachometer 58 (See FIG. 1) may be connected to the apparatus 10 to detect the speed of sheet 16 and to synchronize same with the flow rate of liquid reagent supplied by pumps 56 through speed controller 60 as sheet 16 passes beneath the nozzles 32.

The following examples describe the manner and process of using the invention and set forth the best mode contemplated by the inventor but are not to be construed as limiting.

Preparation 1

(a) In an appropriate vessel 0.5 grams of 2,5-dihydroxybenzoic acid is slurried in 4 milliliters of water. To the slurry, there is then added dropwise with stirring a solution of 10% sodium hydroxide in water until a clear solution is obtained. This is used as a stock 10% solution. Working solutions of 1, 2 and 4% are prepared by appropriate dilution with 0.1M citrate buffer, pH 5.5.

(b) To an appropriate vessel, there is charged 50 microliters of 0.1M citrate buffer pH 5.5, 100 microliters of 2,2'-azino-di-(3-ethyl-benzothiazoline-6-sulphonic acid) in solution (prepared by dissolving 50 milligrams of 2,2'-azino-di-(3-ethyl-benzothiazoline-6-sulphonic acid) (Boehringer Mannheim Corporation, New York, New York, Product No. 15594) in 1.0 milliliter of 2:1 ethyl alcohol and distilled water mixture, 100 microliters of methylcellulose in solution [prepared by dissolving 1 gram of laboratory grade methylcellulose (400 centipoise) (Fisher Scientific Company, Fairlawn, New Jersey, Cat. No. M-280) in 200 milliliters of 1:1 ethyl alcohol and distilled water mixture]. 30 microliters of a 2% working solution of 2,5-dihydroxybenzoic acid (Part (a) above), 100 microliters of a solution of horseradish peroxidase (prepared by dissolving 13.2 milligrams of horseradish peroxidase (Worthington Biochemical Corp., Freehold, New Jersey, Cat. No. HPOD lot no. 34D678, 707.9 U/mg) in 2 milliliters of 0.01M citrate buffer (pH 5.5), 120 microliters of a solution of glucose oxidase (Beekman Instruments Inc., Microbics Operations, Fullerton, California, Cat. No. 680024-3, 2200 1U/ml), and 200 microliters of ethyl alcohol are added to the charge in quantum sufficient to make a total of 700 microliters of reagent composition. The mixture is thoroughly admixed to obtain an aqueous glucose indicating reagent solution.

(c) Four separate and appropriate vessels are each charged with 70 microliters of the indicating reagent solution prepared in (b) above. To each vessel there is then added with mixing, various proportions of the appropriate 2,5-dihydroxybenzoic acid (referred to hereinafter at times as 2,5 DHBA) solutions prepared in (a) supra, to obtain aqueous glucose indicating reagent solutions, each of which will indicate visually a different quantity of glucose in an aqueous solution when exposed to various minimum concentrations of glucose in aqueous solution, by a color change of from substantially colorless to colored. The four vessels are identified by the letters A through D inclusive. The proportion of 2,5-dihydroxybenzoic acid added to each vessel and the minimum glucose concentration of a solution which each reagent composition A through D inclusive will indicate by a color change are shown in Table I (below).

TABLE I

| Vessel | Microliters Citrate Buffers | Microliters of 2,5-dihydroxybenzoic acid (2,5 DHBA) | Final 2,5-DHBA micrograms/ml. | Percent of Min. glucose Conc. in solution required for indication to occur |
|---|---|---|---|---|
| A | 30 of 0.01M | 0 | 600 | 0.1% |
| B | 21 of 0.01M | 9 of 1% | 1500 | 0.25% |
| C | 6 of 0.01M | 24 of 1% | 3000 | 0.5% |
| D | 1.5 of 1.0M | 28.5 of 4% | 12000 | 2.0% |

EXAMPLE 1

The contents of vessels A, B, C and D are transferred to separate refrigerator storage tanks 50, of the previously described apparatus 10. As sheet 16, there is provided a roll 16 of three inch wide hydrophobic filter paper Cat. No. 2499 (Schleicher X Schnell, Inc., Keene, N.Y.). While passing the paper 16 over platen 14 at a speed of 10 feet/minute, the reagent contents of multiple storage tanks 50, are applied to the paper 16 through nozzles 32A, 32B, 32C and 32D, respectively in the manner previously described. The distance between nozzles 32 and platen 14 is about 0.001 inches and the flow rate of reagent is about 4 microliters/linear inch. The applied paper 16 is then passed through a dryer and cut into strips 3 inches long by ¼ inches wide with the lines of dried reagent running across the width of the strip. The indicators so prepared have hydrophobic surfaces except where the dried lines of reagent compositions are adhered. These reagent sites are tightly adhered to the support member and are hydrophyllic sites surrounded by hydrophobic surface area on the hydrophobic support. The dried lines are about 25 mm. wide. The hydrophobic zones between lines are about 25 mm. wide.

Thus, each reagent site bears the same given proportion of reagent on the same given area of the indicator device. There is a uniformity of reagent sites in regard to these critical proportions. Four of the paper strips, each strip bearing the four lines of compositions A, B, C and D (identified as line a, b, c and d, respectively), is then immersed in one of four aqueous solutions containing 0.1 percent, 0.25 percent, 0.5 percent and 2.0 percent glucose, respectively. A fifth strip is a control and is immersed in distilled water. Each strip is immersed in the test solution for a period of about one second and then withdrawn. The withdrawn strip shows a dry surface except at the four lines of reagent deposition which are wet. Within about one minute of immersion, each strip is observed for a change of color in the lines marked thereon. The results are given in Table II below, with the proportion of 2,5-DHBA calculated to be present in each line.

TABLE II

| Strip No. | % of glucose in immersion solution | Line | Proportion of 2,5-DHBA as microgram/line | Color change |
|---|---|---|---|---|
| 1 | 0.1% | a | 0.6 | yes |
| | | b | 1.5 | no |
| | | c | 3.0 | no |
| | | d | 12.0 | no |
| 2 | 0.25% | a | 0.6 | yes |
| | | b | 1.5 | yes |
| | | c | 3.0 | no |
| | | d | 12.0 | no |
| 3 | 0.5% | a | 0.6 | yes |
| | | b | 1.5 | yes |
| | | c | 3.0 | yes |
| | | d | 12.0 | no |
| 4 | 2.0% | a | 0.6 | yes |
| | | b | 1.5 | yes |
| | | c | 3.0 | yes |
| | | d | 12.0 | yes |
| 5 | 0.0% | a | 0.6 | no |
| (control) | | b | 1.5 | no |
| | | c | 3.0 | no |
| | | d | 12.0 | no |

The color changes obtained are a distinct darkening, strongly positive, and those lines which did not change color showed no appreciable darkening. The registrations obtained remained stable for at least 2 hours.

As shown in Example 1, indicators are prepared with the apparatus of the invention having a high degree of accuracy in differentiating between relatively close concentrations of glucose dissolved in an aqueous media. This desirable property is obtained because the controlled hydrophobic areas surrounding the reagent sites assist in picking up a measured volume of test specimen and because complete saturation of the reagent site replaces the evaporated solvent or fluid portion of the reagent composition deposited, with a proportional volume of test specimen. Thus, a predetermined ratio of reagent to test specimen is determined and obtained.

What I claim is:

1. Apparatus for applying a predetermined pattern of an aqueous liquid containing a chemical indicator reagent to a flat, moving sheet having a hydrophobic surface, whereby a constant volume of the liquid is deposited on a constant area of the hydrophobic surface, which comprises;

a fixed platen having a flat surface to support a sheet traveling thereover;

means for feeding a flat sheet to the surface of said platen;

means for drawing the sheet across the surface of said platen at an adjustable, fixed speed of from about 5 to about 20 feet per minute and within 1 percent of the set fixed speed;

a header for mounting a plurality of liquid dispensing nozzles over the surface of said platen, said header being adjustable in a vertical plane and adapted to hold in a rigid position a plurality of said nozzles;

a plurality of liquid dispensing nozzles mounted in said header;

means for positioning the plurality of nozzles in the header a uniform distance above the surface of the platen and above the flat sheet drawn across the surface of the platen so that there is a gap between the moving sheet and the nozzles, said nozzles being set as close to the moving sheet as physically possible; and means for supplying to said nozzles an uninterrupted, pulse-free flow of the aqueous liquid reagent, at a constant volume rate of from about 2 to about 4 microliters per linear inch of the moving sheet.

2. The apparatus of claim 1 wherein said means for feeding comprises a feed roller and a plurality of tension rollers.

3. The apparatus of claim 1 wherein said means for drawing the sheet comprise a driven roller and a pinch roller forming a nip therebetween.

4. The apparatus of claim 1 wherein said means for positioning comprises a vertically adjustable carriage.

5. The apparatus of claim 1 wherein said means for supplying comprises syringe pumps.

6. The apparatus of claim 5 wherein said means for supplying the liquid reagent to said nozzles also includes conduit means between each of said pumps and each of said nozzles.

7. The apparatus of claim 1 which additionally comprises means for cooling said reagent, means for mixing said reagent, means for delivering the mixed, refrigerated reagent to syringe pumps, syringe pumps and conduit means for delivering the refrigerated, mixed reagent from said syringe pumps to said nozzles.

* * * * *